US005286704A

United States Patent [19]

Yoshikawa et al.

[11] Patent Number: 5,286,704

[45] Date of Patent: Feb. 15, 1994

[54] HEAT-SENSITIVE RECORDING MEDIUM

[75] Inventors: Motonao Yoshikawa, Shizuoka; Katsumi Moronuki, Koganei, both of Japan

[73] Assignee: Honshu Paper Co., Ltd., Tokyo, Japan

[21] Appl. No.: 953,307

[22] Filed: Sep. 28, 1992

Related U.S. Application Data

[63] Continuation of Ser. No. 644,907, Jan. 23, 1991, abandoned.

[51] Int. Cl.[5] ..... B41M 5/40

[52] U.S. Cl. ..... 503/226; 430/160; 503/200

[58] Field of Search ..... 427/152; 503/200, 226; 430/160

[56] References Cited

U.S. PATENT DOCUMENTS 4,996,182 2/1991 Matsui et al. ..... 503/200

FOREIGN PATENT DOCUMENTS

| | | | |
|---|---|---|---|
| 187449 | 7/1986 | European Pat. Off. | 503/200 |
| 304936 | 3/1989 | European Pat. Off. . | |
| 361500 | 4/1990 | European Pat. Off. . | |
| 57-69095 | 4/1982 | Japan . | |
| 202439 | 11/1983 | Japan | 503/200 |
| 58-211497 | 12/1983 | Japan . | |
| 59-148693 | 8/1984 | Japan | 503/200 |
| 62-268685 | 11/1987 | Japan | 503/200 |
| 2114767 | 8/1983 | United Kingdom . | |

*Primary Examiner*—Pamela R. Schwartz
*Attorney, Agent, or Firm*—Seed and Berry

[57] ABSTRACT

The present invention relates to a heat-sensitive recording medium which is excellent in dot-reproducibility and in adhesion between a support and a heat-sensitive recording layer provided thereon. The present recording medium comprises a synthetic-resin support, an ionomer-resin layer on the support, and a heat-sensitive recording layer provided on the ionomer-resin layer.

4 Claims, No Drawings

HEAT-SENSITIVE RECORDING MEDIUM

CROSS-REFERENCE TO RELATED APPLICATION

This application is a continuation of U.S. application Ser. No. 07/644,907 filed Jan. 23, 1991, now abandoned.

DESCRIPTION

1. Technical Field

The present invention relates to a heat-sensitive recording medium, in particular, to a heat-sensitive recording medium which is excellent in dot reproducibility and in adhesion between a support and a heat-sensitive recording layer.

2. Background of the Invention

A heat-sensitive recording system is advantageous in that no development/fixing step is necessary, and maintenance for hardware is easy. Accordingly, this system has been recently and widely used in recording television images and in recording media for various printers, facsimile machines, and laboratory instruments. The properties necessary for these recording media are dependent on their applications. For example, in order for a halftone recording to be adequately done, a heat-sensitive recording medium must have good dot-reproducibility.

As support for heat-sensitive recording media, various sheet supports (e.g., paper) and various film supports (e.g., synthetic resin films) have been used.

The dot-reproducibility and color-developability of paper are generally not good, although it is inexpensive. Film supports do not have this deficiency, but their adhesion to aqueous coating solution which forms a heat-sensitive recording layer is poor, in that the heat-sensitive recording layer is easily peeled from the support.

Methods have been proposed to improve the adhesion of the recording layer to the synthetic-resin film support. One is to apply corona discharge to the film; the other is to coarsen the film surface. The former method does not adequately improve adhesion; the latter reduces the smoothness of the film and thereby renders dot-reproducibility insufficient.

SUMMARY OF THE INVENTION

The objective of the present invention is to provide a heat-sensitive recording medium that is excellent both in dot-reproducibility and in adhesion of a heat-sensitive recording layer to a support.

The present inventor has made intensive studies to accomplish the above objective, and has found that this objective can be attained by making a support from a synthetic resin and providing an ionomer resin between the support and the heat-sensitive recording layer. The present invention has been completed on the basis of this finding.

DETAILED DESCRIPTION OF THE INVENTION

As a synthetic resin to be used as a support, any known resin (polyethylene, polypropylene, polyethylene terephthalate, polycarbonate, polystyrene, nylon, cellulose diacetate, cellulose triacetate, etc.) can be used.

If necessary, the support of the present invention can be subjected to corona discharge, in order to improve its adhesion to an ionomer resin layer to be provided thereon. The support also may be laminated with a sheet of paper or other sheet materials on the side opposite to that where the ionomer resin layer is to be formed.

Any kinds of ionomer resins can be used in the present invention. Preferable ionomer resins are copolymers of an $\alpha$-olefin and an $\alpha$, $\beta$-unsaturated carboxylic acid, wherein ionic crosslinking is formed with one or more kinds of metal ions.

The $\alpha$-olefins usable for forming the copolymers of the ionomer resins have a general formula: $RCH{=}CH_2$. The group R means a hydrogen atom or an alkyl group. The alkyl group preferably has a carbon number of 1 to 8. Preferable olefins include ethylene, propylene, butene-1, pentene-1, hexene-1, heptene-1, 3-methylbutene-1 and 4-methylpentene-1.

Preferable $\alpha,\beta$-unsaturated carboxylic acids are those of C3 to C8 and include acrylic acid, methacrylic acid, ethacrylic acid, itaconic acid, maleic acid and fumaric acid, and their esters(e.g., methyl acrylate, ethyl acrylate, methyl methacrylate, n-butyl methacrylate, dimethyl fumarate, diethyl itaconate and dimethyl maleate).

The $\alpha$-olefins and $\alpha$, $\beta$-unsaturated carboxylic acids may be used as a combination of more than one compound.

Metal ions suitable for producing the ionomer resins include those having a variance of one to three. Suitable mono valent metal ions include $Na^+$, $K^+$, $Li^-$, $Cs^+$, $Ag^+$, and $Hg^+$. Divalent metal ions include $Be^{++}$, $Mg^{++}$, $Ca^{++}$, $Sr^{++}$, $Ba^{++}$, $Cu^{++}$, $Cd^{++}$, $Hg^{++}$, $Sn^{++}$, $Pb^{++}$, $Fe^{++}$, $Co^{++}$, $Ni^{++}$, and $Zn^{++}$. Trivalent metal ions include $Al^{+++}$, $SC^{+++}$, $Fe^{+++}$, and $Y^{+++}$. It is preferable that the metal ion be $Na^+$, $Mg^{++}$or $Zn^{++}$in the present invention.

If necessary, the ionomer resin layer may be subjected to corona discharge to improve its adhesion to a heat-sensitive recording layer to be formed thereon.

The ionomer resin layer is usually laminated onto the support as follows:

(1) Anchor treatment is made on the support film (e.g., biaxially oriented polypropylene) and an ionomer-resin layer is laminated onto the film either by extrusion or by coating, onto the film, in a known manner, either the ionomer resin solution or the emulsion.

(2) In the production of a support film (e.g., biaxially oriented polypropylene), an ionomer resin and a polypropylene resin are extruded together to form an integrated film, an ionomer resin is extruded to laminate a resin (e.g., polypropylene resin) before orientation of the film, or either an ionomer resin solution or an emulsion is coated onto the film before orientation is made.

Additives usually used for resins (e.g., polypropylene resin, ionomer resin) including antioxidants, antistatic agents, slip agents, etc., may be used.

Heat-sensitive recording layers usable in the present invention may be of any type, e.g., leuco, chelate, and diazo. The recording layer contains a coloring compound and a binder wherein the coloring compound is dispersed and fixed throughout.

A leuco-type recording medium contains, as a coloring compound, a colorless-to-pale leuco compound and an organic acid. The leuco compound develops color when it reacts with the organic acid.

The leuco compounds include various derivatives of triphenylmethanes, triphenylmethane phthalides, fluorans, leuco-auramines, diphenylmethanes, phenothiazines, spiropiranes, indolines, and indigos. Preferable leuco compounds include crystal violet lactone, 3-diethylamino-6-methyl-7-anilinofluoran, 3-(N-ethyl-p-toluidino)-6-methyl-7-anilinofluoran, 3-diethyl-amino-6-methyl-7-(o- or p-dimethylanilino) fluoran, 3-pyperidino-6-methyl-7-anilinofluoran, 3-(N-cyclohexyl-N-methylamino)-6-methyl-7-anilinofuoran, 3-diethylamino-7-(o-chloroanilino) fluoran, 3-diethylamino-7-(m-trifluoromethylanilino) fluoran, 3-diethylamino-6-methyl-chlorofluoran, 3-diethylamino-6-methylfluoran, 3-(N-isoamyl-N-ehtylamino)-6-methyl-7-anilinofluoran, 3-dibutylamino-6-methyl-7-anilinofluoran, etc.

Organic acids usable with the leuco compounds are these which are melted by heat and develop color upon contact with the leuco compounds. The organic acids include various phenolic compounds, aliphatic acids, aromatic carboxylic acids, etc. They include gallic acid, salicylic acid, 1-hydroxy-2-naphthoic acid, 0-hydroxybenzoic acid, m-hydroxybenzoic acid, 2-hydroxy-p-toluic acid, 3,5-xylenol, thymol, p-tert-butylphenol, 4-hydroxyphenoxide, methyl-4-hydroxybenzoate, 4-hydroxy-acetophenone,α-naphthol,β-naphthol, catechol resorcinol, hydroquinone, 4-tert-octyl-catechol, 4,4'-sec-butylidenephenol, 2,2'-dihydroxydiphenyl, 2,2'-methylene-bis (4-methyl-6-tertbustylphenol). 2,2'-bis (4-hydroxyphenyl) propane (namely, bisphenol A), 4,4'-isopropylidenebis (2-tert-butylphenol), pyrogallol, phloroglucin, phloroglucin carboxylic acid, p-methylphenol, p-phenylphenol, 4,4'-cyclohexylidenediphenol, 4,4'-isopropylidene-dicatechol, 4,4'-benzylidenediphenol, 4,4'-isopropylidene bis (2-chlorophenol), 3-phenylsalicylic acid, 3,5-di-tert-butylsalicylic acid, 1-hydroxy-2-naphthoic acid, a gallic ester, a salycilate, a p-hydroxybenzoate, a 4-hydroxyphthalate, 2-(4-hydroxyphenyl)-2-(3'-hydroxyphenyl) propane, 4,4'-dihydroxy-3,3'-diisopropyldiphenyl-2,2'-propane, etc.

The chelate-type heat-sensitive recording layer contains, as a coloring compound, (a) a heavy- or noble-metal salt of an organic acid and (b) an organic reducing agent, a sulfur compound, or an amino compound. Either of the compounds (a) and (b), or both, are melted by heat and the two react with each other to form a chelate compound and develop color. Possible combinations of (a) and (b) include:

An iron salt of a long-chain aliphatic acid (e.g., ferric stearate, ferric myristate) and phenols (e.g., tannic acid, gallic acid, ammonium salicylate); a heavy-metal salt of an organic acid (e.g., Ni, Co, Pb, Cu, Fe, Mg, or Ag salt of acetic acid; stearic acid; palmitic acid), and an alkaline earth-metal sulfide (e.g., CaS, SrS, BaS) or an organic chelating agent (e.g., S-diphenylcarbazide, diphenylcarbazone); a heavy-metal oxalate (e.g., Ag, Pb, Hg, Th salt of oxalic acid) and a sulfur compound (e.g., Na tetrathionate, thiosulfate soda, thiourea); a noble-metal salt of an organic acid (e.g., silver oxalate, mercury oxalate) and an organic polyhydroxy compound (e.g., polyhydroxy alcohol, glycerine, glycol); a noble-metal salt of an organic acid (e.g., silver behenate, silver stearate) and an aryl organic reducing agent (e.g., protocatechuic acid, spiroindane, hydroquinone); a ferric salt of an aliphatic acid (e.g., ferric stearate) and an aryl polyhydroxy compound (e.g., 3,4-dihydroxytetraphenylmethane); a metal salt of an organic acid (e.g., silver behenate, silver acid phthalate) and a cyclic organic reducing agent (e.g., protocatechuic acid, 2,3-dihydroxybenzoic acid, 4-methoxy-1-hydroxynaphthalene, hydroquinone, catechol); a ferric salt of an aliphatic acid (e.g., ferric palargonate, ferric laurate) and thiosemicarbazide or isothiosemicarbazide derivative); a lead salt of an organic acid (e.g., lead caproate, lead pelargonate, lead behenate) and a thiourea derivative (e.g., ethylene thiourea, N-dodecylthiourea); a heavy-metal salt of a higher aliphatic acid (e.g., ferric stearate, copper stearate) and a zinc salt of a disubstituted dithiocarbamic acid derivative (e.g., zinc dibutylthiocarbamate); a metal salt (nickel acetate) and a sulfur-releasing compound (e.g., thiooxalic acid, thioacetamide); a metal salt (e.g., nickel stearate, cobalt behenate, gold chloride) and N,N'-substituted rubeanic acid; a bismuth salt (e.g., borate, oxychloride, salicylate, benzoate) and a tin compound, as a releasing agent (e.g., tin sulfide, tin hydroxide); a Grignard-type organic-metal compound and a sulfur compound (e.g., thiuram, thiouran, thioamide).

The diazo-type heat-sensitive recording layer contains, as a coloring compound, the following two systems:

(1) a diazosulfonate, which is stable at room temperature, and a coupler. The diazosulfonate is made to react with the coupler by light or heat to cause color-development reaction and form a diazo dye.

(2) a hydrophobic diazonium compound, a coupler, and a heat-meltable basic compound. The diazonium compound (e.g., diazonium salt) is heated in the presence of the coupler and the heat-meltable basic compound to cause reaction between the diazonium compound and the coupler, because the system becomes alkaline due to heat, so that a diazo dye is formed.

In this case, it is advantageous to capsulize the hydrophobic diazo compound in a microcapsule having a polyurethane wall, by means of interfacial polymerization, to separate it from the other materials, so as to improve a pot life.

The diazonium salt may be soluble in water insoluble in water, or hardly soluble in water.

Water-soluble diazonium salts include p-diazo-N-ethyl-N-hydroxyaniline chloride.zinc chloride, p-diazo-N,N-dimethylaniline chloride.zinc chloride, p-diazo-N,N-diethylaniline chloride.zinc chloride, 4-benzamide-2,3-diethoxybenzenediazonium chloride.zinc chloride, 2-methoxy-4-morpholino-benzenediazonium chloride.zinc chloride, 4-morpholine-2,5-dibutoxybenzene-diazonium chloride.zinc chloride, etc.

Diazonium salts insoluble or hardly soluble in water include those which have, as a counter anion, tetrafluoroborate ($BF_4^-$) hexafluoraphosphate ($PF_6^-$), and the following formula:

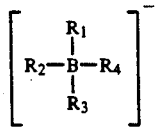

wherein $R_1$ to $R_4$ may be independently an alkyl group, an alkenyl group, a cycloalkyl group, an allyl group, an aryl group, a heterocyclic group or a cyano group.

The diazonium salt may be a mixture of two or more of the above-mentioned diazonium salts.

Couplers usable in the present invention include resorcinol, α-naphthol-2,7-dihydroxynaphthalene, sodium 2-hydroxynaphthalene-3,6-disulfonate, sodium 2,3-dihydroxynaphthalene-6-sulfonate, acetoacetoanilide, 2-hydroxy-3-naphthoic acid-ethanol amide, 2-hydroxy-3-naphthoic acid-o-toluidinoamide. As a coupler having a basic residual group, there may be mentioned the one having the following formula;

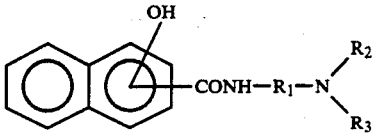

wherein $R_1$ is an alkyl group of $C_1$–$C_{18}$, and $R_2$ and $R_3$ are alkyl groups or functional groups which form a heterocyclic ring with the N atom to which they bind.

The heat-meltable basic compound has the ability to make the system basic when it is heated to melt, dissolve, or decompose. Basic compounds include inorganic and organic ammonium salts, organic amines, urea or derivatives thereof, guanidine derivatives, piperadines, imidazoles, nitrogen-atom-containing heterocyclic compounds (e.g., morpholines), and salts (e.g., sodium acetate, potassium malonate).

The coloring compound may contain an acid stabilizer (e.g., tartaric acid, citric acid, boric acid) to prevent precoupling.

The coloring agent also contains an antioxidant (e.g., thiourea, ascorbic acid) and a stabilizer for diazonium salts (e.g., zinc chloride).

The coloring compound may further contain various pigments and wax (e.g., paraffin wax, montan wax, amide wax) to improve coloring sensitivity and color density.

Most binders usable in the present invention are water-soluble; all separately fix the coloring compound dispersed in a fine-grain form.

Binders include polyvinyl-alcohol, epoxy-modified polyvinyl alcohol, methyl cellulose, carboxymethyl cellulose, hydroxyethyl cellulose, polyacrylic acid, casein, gelatin, and starch, and their derivatives.

The heat-sensitive recording layer may contain inorganic and organic pigments (e.g., clay, calcium carbonate, synthetic silica, aluminum hydroxide, talc, titanium oxide, zinc oxide), antioxidants for storage stability, absorbers for ultraviolet rays, waterproofers for improving water resistance, phenolic resin, surfactants, conventional wax, metal salts of higher aliphatic acids, etc.

The recording layer may also contain heat-meltable materials for improving coloring, sensitizer, if necessary.

The coating material for the heat-sensitive recording layer generally is prepared by pulverizing and dispersing the coloring compound and, if necessary, various additives (pigment, stabilizer, sensitizer, etc.) in an aqueous medium containing a binder (e.g., polyvinyl alcohol) at a suitable concentration and by a suitable pulverizer/disperser such as a ball mill or sand grinder.

To enhance coloring efficiency, each component of the coating material should be as fine as possible, preferably no greater than 3 μm in particle diameter.

The resultant coating material is coated on the ionomer resin provided on the support, and is then dried, to form the present heat-sensitive recording medium.

The coating usually may be made by a suitable coating machine such as a blade coater, an air-knife coater, a bar coater, or a reverse-roll coater.

EXAMPLES

The present invention will be further explained in detail by reference to the following nonlimitative examples.

EXAMPLE 1

A. Production of a Support Having an Ionomer Resin Layer

A polypropylene sheet extruded from a T-die was oriented in one direction to five times its original size. One side of the resultant oriented sheet having a thickness of 200 μm was subjected to corona discharge. Ionomer emulsion (Chemipearl S, produced by Mitsui Petrochemical Industries, Ltd.) was coated on the corona-discharge-treated side of the oriented sheet, so that the solid content after drying was 2 g/m$^2$, and immediately was laterally oriented to nine times (root-mean-square) its original size by continuously passing the sheet through a tentering machine.

The sheet then was subjected to corona discharge, at the side where the ionomer layer was coated, to yield a support having an ionomer layer having a surface tension of 50 dyne/cm and a thickness of 0.2 μm.

B. Production of a Heat-Sensitive Recording Medium

Each of the solutions described below was prepared by ten hours of mixing by a paint-shaker (produced by Toyo Seiki, K.K.).

| | |
|---|---|
| Solution A | |
| Leuco dye: 3-dibutylamino-6-methyl-7-anilinofluoran | 5 g |
| Zinc stearate | 5 g |
| Polyvinylalcohol (12%) | 40 g |
| Water | 50 g |
| Solution B | |
| Bisphenol A | 10 g |
| Zinc stearate | 3 g |
| Polyvinylalcohol (12%) | 40 g |
| Water | 47 g |

100 g of Solution A, 100 g of Solution B, 50 g of a 12% polyvinylalcohol solution, 15 g of synthetic silica (P-832, produced by Mizusawa Chemical, K.K.), and 60 g of water were stirred together to form a coating solution. The coating solution was coated onto the ionomer layer on the support by means of a Wire bar so that the coating weight (after drying) was 8 g/m$^2$, and then was dried, to produce Heat-Sensitive Recording Medium A.

EXAMPLE 2

The procedure of Example 1 was performed, with 10 g of ferric stearate in place of the leuco dye in Solution A, and 20 g of stearyl gallate in place of the bisphenol A in Solution B, yielding Heat-Sensitive Recording Medium B.

EXAMPLE 3

The procedure of Example 1 was performed, with epoxy-modified polyvinyl alcohol (DR587, produced by Denki Kagaku, K.K.) in place of the 12% polyvinylalcohol solution added when Solution A was mixed with Solution B, yielding Heat-Sensitive Recording Medium C.

Example 4

The following solutions were prepared:

Solution A

Diazonium compound:

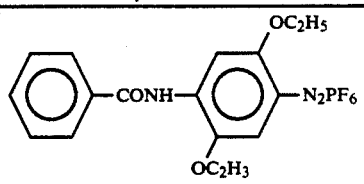

10 g

| | |
|---|---|
| Zinc stearate | 5 g |
| Polyvinylalcohol (12%) | 40 g |
| Water | 50 g |

Solution B

Coupler:

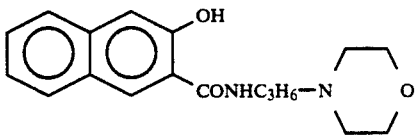

10 g

| | |
|---|---|
| Polyvinylalcohol (12%) | 30 g |
| Water | 37 g |

Solution C

| | |
|---|---|
| Basic compound | |
| 1,3-di-o-tolylguanidine | 3 g |
| Heat sensitizer: | |
| 2-Naphthyl benzoic acid | 5 g |
| Polyvinylalcohol (12%) | 20 g |
| Water | 20 g |

Then, 105 g of Solution A, 77 g of Solution B, 48 g of Solution C, 50 g of a 12% polyvinylalcohol solution, 15 g of synthetic silica (P-832 produced by Mizusawa Chemical, K.K.), and 60 g of water were stirred together, yielding a coating solution which then was coated onto the ionomer layer on the support as in Example 1, yielding Heat-Sensitive Recording Medium D.

COMPARATIVE EXAMPLE 1

The procedure of Example 1 was performed without the ionomer layer, yielding Heat-Sensitive Recording Medium E.

COMPARATIVE EXAMPLE 2

The procedure of Example 1 was performed without the ionomer layer and the support coarsened by sandblast method instead of subjected to corona discharge, yielding Heat-Sensitive Recording Medium F.

Heat-Sensitive Recording Media A-F were subjected to the following tests:

(to determine the adhesion of a heat-sensitive recording layer to a support)

Test 1

Commercially available mending tape was placed onto the recording layer, the tape was peeled from the recording layer, and the surface of the recording layer was visually observed.

Test 2

(to determine image density and dot-reproducibility)

Solid printing was performed by means of a commercially available thermal head (KFT-216-8 MPD I (Kyocera K.K.J) having a printing power of 0.7 W/dot, a pulse cycle of 5.0 msec, and a pulse width of 0.3 msec. The density of the resultant image and the background density were determined by means of a densitometer (Macbeth RD-914). Dot-reproducibility was determined by visual observation.

Test 3

(to determine moisture-vapor resistance and heat resistance)

After Test 2 had been performed, Heat-Sensitive Recording Media A, B, C, E, and F were stored for 24 hours at 40° C. in 90% RH and at 60° C. in 30% RH. Background density and image density were then determined as in Test 2.

The moisture-vapor resistance and heat resistance of Heat-Sensitive Recording Medium D were determined after the medium had been exposed to the light of two 85 W ultraviolet-ray lamps for 10 sec at a distance of 2 cm and had been fixed after the completion of the printing.

TABLE 1

The results of these tests are shown in Table I.

| Heat Sensitive Recording Medium | Adhensive (Peeding Off) | Dot Reproducibility | Background Density | Image Density | Moisture Vapor Resistance Background Density | Moisture Vapor Resistance Image Density | Heat Resistance Background Density | Heat Resistance Image Density |
|---|---|---|---|---|---|---|---|---|
| A | ◎ | ○ | 0.03 | 1.28 | 0.08 | 1.25 | 0.09 | 1.24 |
| B | ◎ | ○ | 0.08 | 1.03 | 0.12 | 0.98 | 0.15 | 1.02 |
| C | ◎ | ○ | 0.03 | 1.28 | 0.08 | 1.25 | 0.09 | 1.24 |
| D | ◎ | ○ | 0.05 | 1.12 | 0.05 | 1.13 | 0.05 | 1.12 |
| E | X | ○ | 0.03 | 1.27 | 0.09 | 1.26 | 0.08 | 1.24 |
| F | ○ | X | 0.03 | 1.14 | 0.09 | 1.09 | 0.09 | 1.06 |

Table I shows that, by providing an ionomer-resin layer between the support and the heat-sensitive recording layer, an excellent heat-sensitive recording medium can be obtained, wherein dot-reproducibility and adhesion between the support and the heat-sensitive recording layer are superior to those of the prior art recording medium.

We claim:

1. A heat-sensitive recording medium, comprising:
(a) a biaxially oriented polypropylene film support;
(b) a ionomer-resin layer on said support; and
(c) a heat-sensitive recording layer on said ionomer-resin.

2. The heat-sensitive recording medium of claim 1, wherein said ionomer resin layer comprises a polymer containing an ionic crosslinking.

3. The heat-sensitive recording medium of claim 2, wherein said polymer is a copolymer produced by polymerizing an olefin with an $\alpha$, $\beta$-unsaturated carboxylic acid or its ester, and wherein all or a part of the hydrogen atoms or ester groups of the carboxyl groups are replaced by metal.

4. The heat-sensitive recording medium of claim 1, wherein said recording layer is leuco-type, chelate-type, or diazo-type.

* * * * *